United States Patent [19]

Gearhart et al.

[11] 3,964,556

[45] June 22, 1976

[54] DOWNHOLE SIGNALING SYSTEM

[75] Inventors: Marvin Gearhart; David W. King; Rudolph R. Mendoza; Serge A. Scherbatskoy; James D. Young, all of Fort Worth, Tex.

[73] Assignee: Gearhart-Owen Industries, Inc., Fort Worth, Tex.

[22] Filed: July 10, 1974

[21] Appl. No.: 487,099

[52] U.S. Cl. ..... 175/45; 340/18 NC; 166/224 A

[51] Int. Cl.[2] ..... E21B 47/02

[58] Field of Search ..... 175/40, 48, 45, 46, 175/50; 340/18 NC, 18 LD, 18 P, 18 R

[56] References Cited

UNITED STATES PATENTS

| | | | |
|---|---|---|---|
| 2,255,721 | 9/1941 | Mattingly et al. | 175/45 |
| 2,953,350 | 9/1960 | Moore | 175/45 X |
| 3,115,942 | 12/1963 | Arps | 175/50 |
| 3,122,213 | 2/1964 | Hawk | 175/45 |
| 3,316,651 | 5/1967 | Godbey | 175/45 X |

*Primary Examiner*—Ernest R. Purser
*Assistant Examiner*—Richard E. Favreau
*Attorney, Agent, or Firm*—John D. Gassett; Paul F. Hawley

[57] ABSTRACT

This describes a method for improved data signaling equipment for use with well-drilling tools for rapidly sending measurements made down the hole in the wellbore to the surface without the need of an electric cable. A special well tool is connected into a drill string having a drill bit coupled thereto for drilling a borehole. During normal drilling operations, the data-sending equipment is not in operation, and the main body of circulating or drilling fluid is passed through a main valve in the downhole tool and bypasses a pressure-changing unit. A sensing unit is incorporated in the downhole tool and measures downhole parameters. When it is desired to send these data to the surface, the main circulation of drilling fluid is stopped and the bypass valve closed. Then, a small amount of fluid is supplied to the "closed" drill string from a substantially constant-pressure source. Pressure changes are then generated in this closed fluid-filled drill pipe under quiescent conditions while the drilling operations are momentarily halted.

17 Claims, 15 Drawing Figures

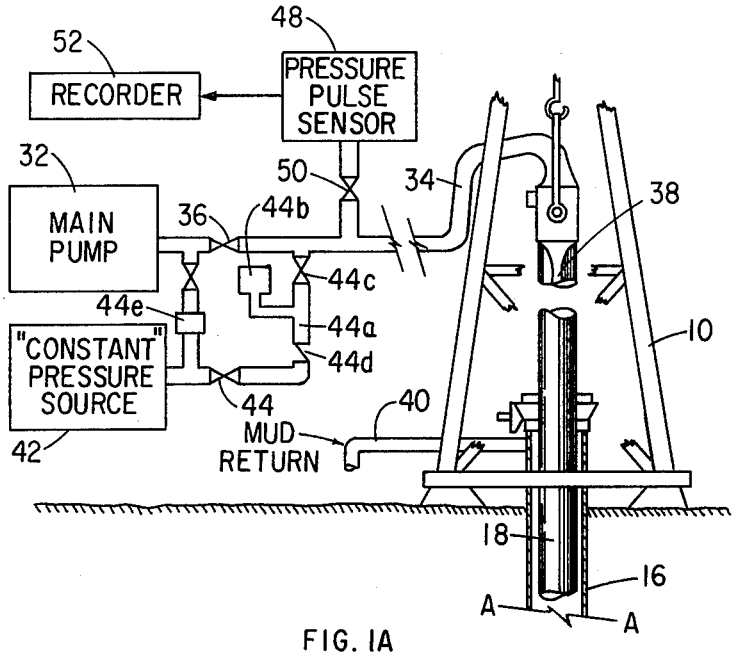
FIG. IA
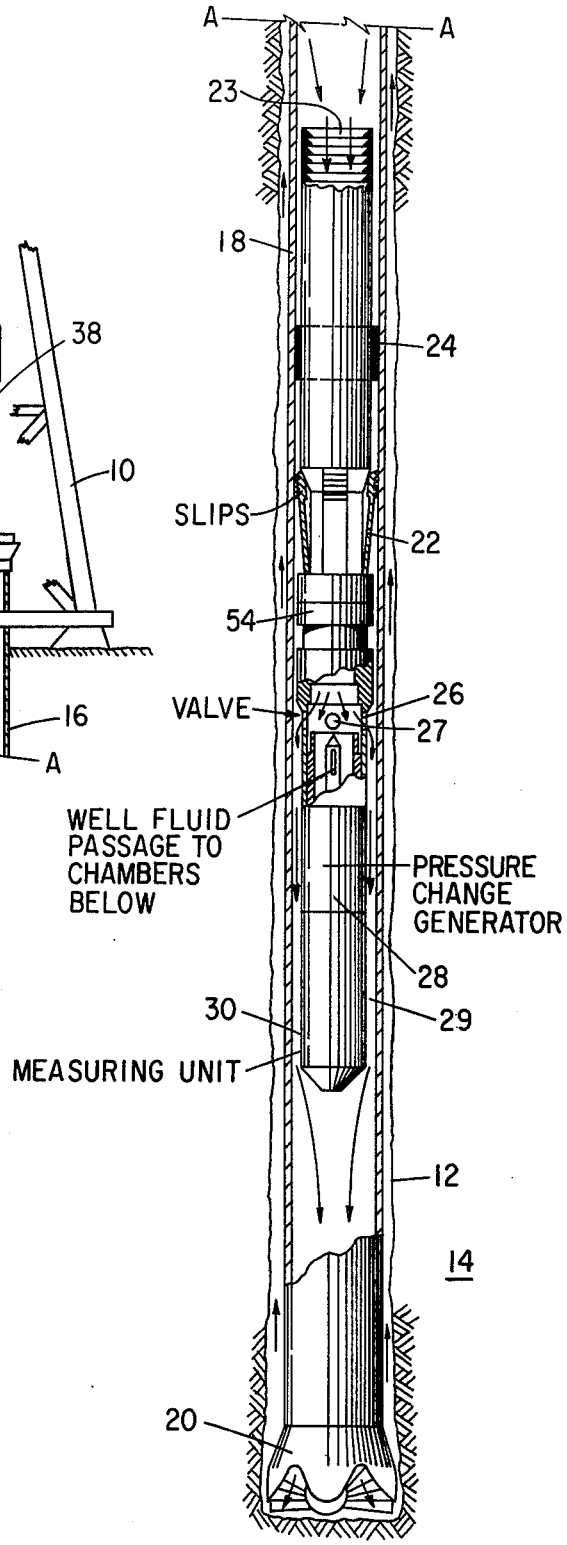
FIG. IB

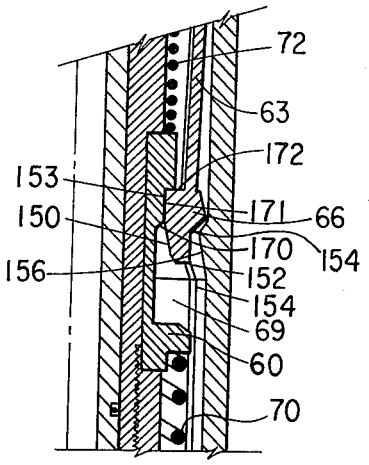
FIG. 5A
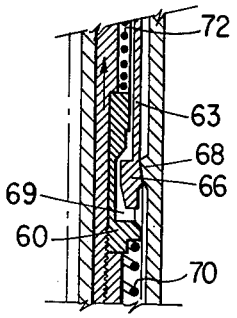
FIG. 5
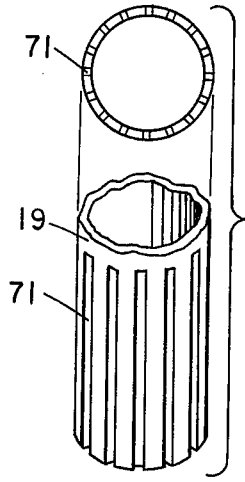
FIG. 6
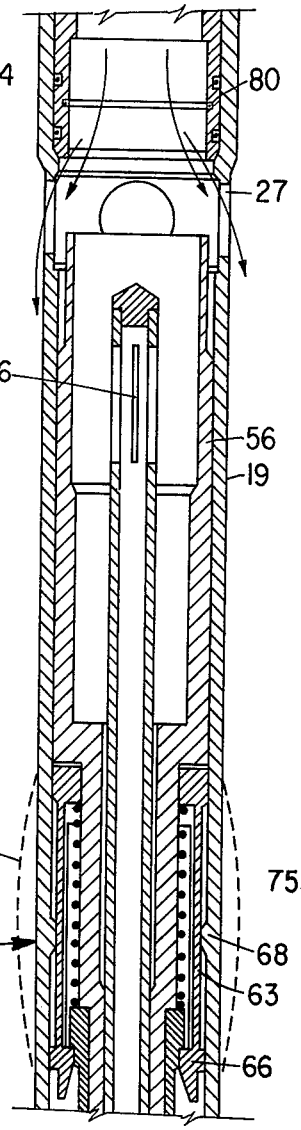
FIG. 3
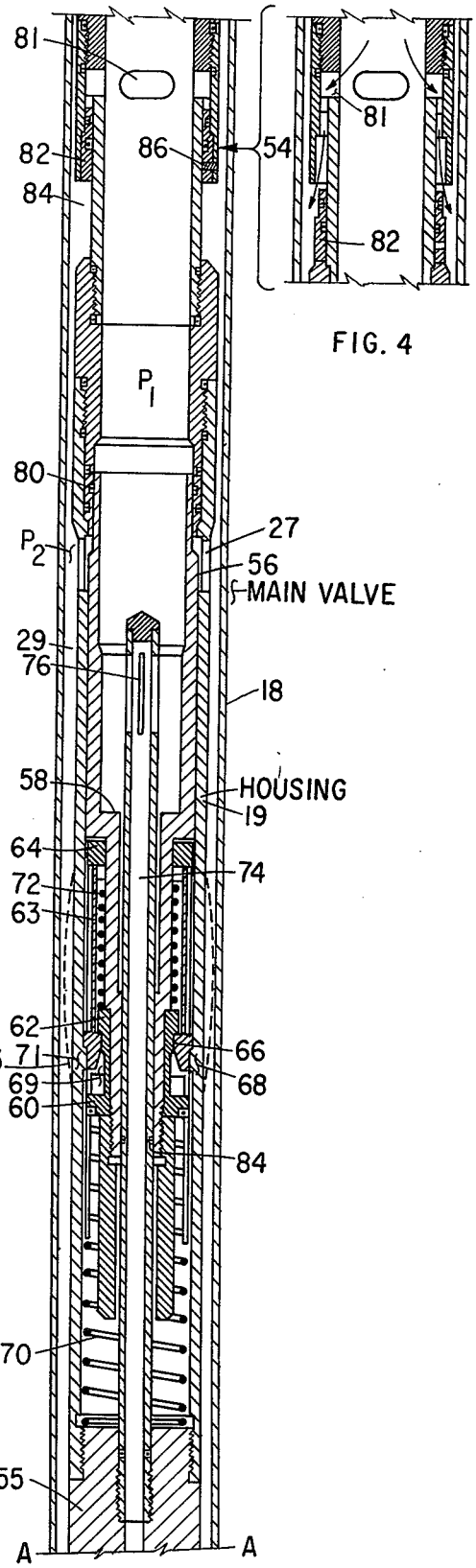
FIG. 2
FIG. 4

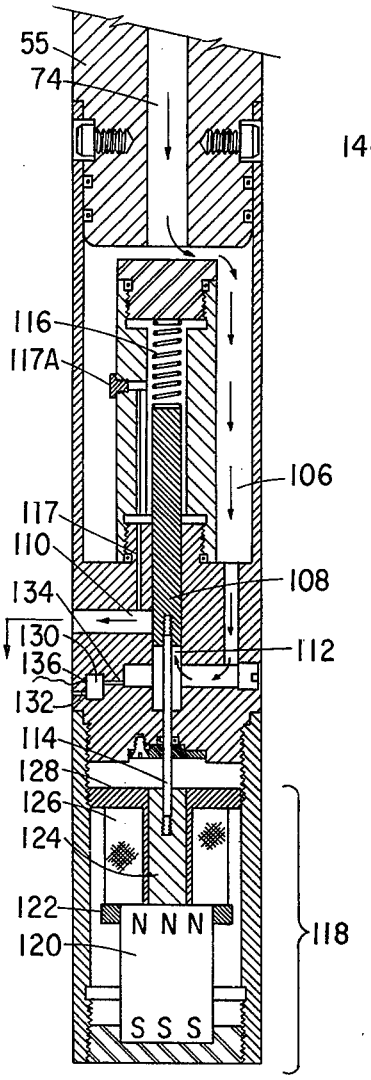
FIG. 7
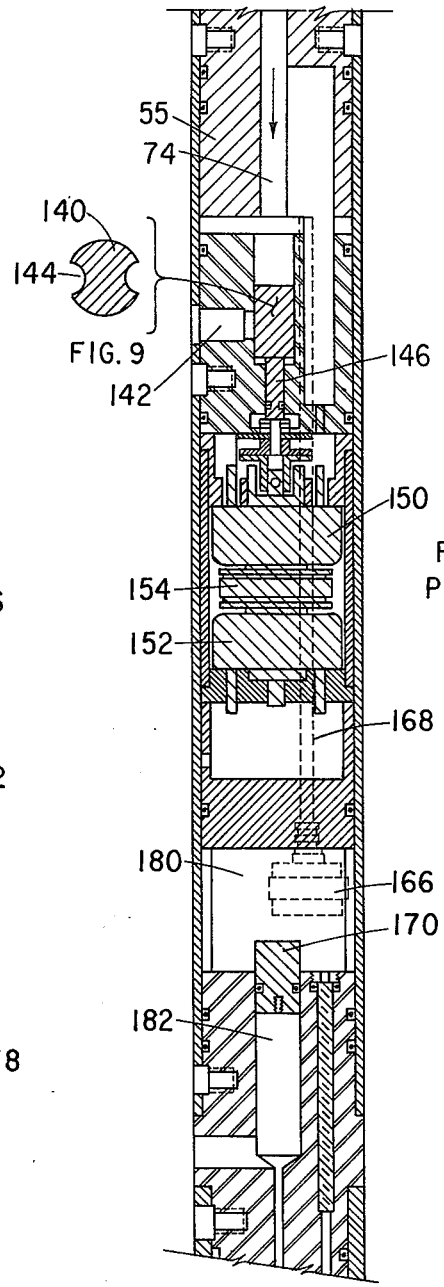
FIG. 9
FIG. 8
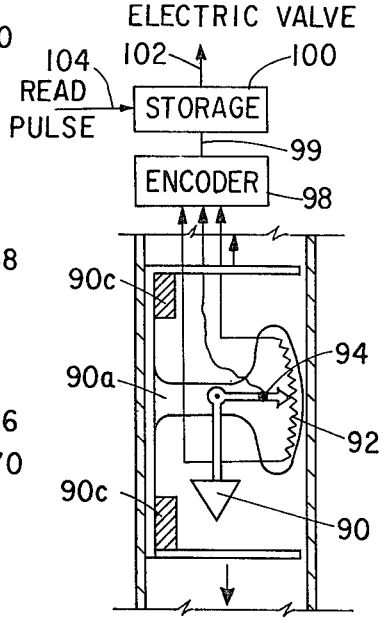
FIG. 10

DOWNHOLE SIGNALING SYSTEM

BACKGROUND OF THE INVENTION

This invention relates to telemetry of signals in a fluid system and more particularly relates to a method and apparatus for sending signals up a wellbore from a downhole unit in a logging-while-drilling system.

It has long been recognized that efficiency of drilling operations could be greatly improved if there were a system able to measure downhole drilling parameters and/or formation characteristics and transmit them to the surface during drilling operations, or with only momentary interruptions of the drilling operations.

Several such systems have been proposed and are commonly referred to as "logging-while-drilling" systems. In logging-while-drilling systems, one of the major problems exists in finding a means for telemetering the information concerning the desired parameter from a downhole location to the surface and have it arrive in a meaningful condition.

It has been proposed to telemeter the desired information by means of a continuous pressure-wave signal generated within the mud system normally associated with rotary drilling operations. The pressure wave signal which is representative of a particular parameter is generated in the mud near the bit by a generating means and the wave travels up the hole through the mud to a signal detector at the surface. Present systems, using circulating mud as a medium for telemetering, have obvious difficulties in that the normal mud pump pulsations and other extraneous vibrations, shocks, etc., of the drilling equipment give an unwanted pressure wave or noise to the mud which may seriously distort or mask the desired signal being transmitted in the mud at that time. It is to be noted that the present invention described herein concerns a method for transmitting signals uphole through the fluid in a manner to avoid most of the interferences associated with the previous systems. This will be explained in detail hereinafter.

There are many logging-while-drilling patents issued. Typical of those include: U.S. Pat. Nos. 3,742,443; 3,736,558; 3,302,457; 3,739,331; 3,736,558; 3,732,728; 3,737,843; and 3,727,179.

SUMMARY OF THE INVENTION

This concerns a method of logging a well which is in the process of being drilled by a conventional method of circulating a drilling fluid down through a tubular member suspended in the wellbore and out through passages in the bit and back to the surface through the annulus between the drill string and the borehole wall. We stop the circulation of the main drilling fluid by closing the lower end of the tubular member or drill string and removing from the principal mud circuit the main mud pump at the surface. We then supply fluid, such as water, at a substantially constant pressure to the drill string at the surface. We then turn the instrument "on" by means such as a pressure actuated timed switch and measure a downhole parameter, for example, borehole inclination. Pressure signals are then generated at the bottom of the drill string in the quiescent fluid in response to the measured parameter. Detecting means are placed at the surface to detect the pressure pulses as they arrive. In another embodiment of this invention downhole parameters can be measured while the drilling is in progress, the measurements are then stored in the subsurface instrument and transmitted during the quiescent interval while circulation is stopped. Means for closing the lower end of the drill string to stop the circulation of drilling fluid will be described in detail as will also the pressure signal generating means.

BRIEF DESCRIPTION OF THE DRAWINGS

A better understanding of the operation of the tool and its components and the system can be better accomplished referring to the drawings in connection with the following description in which FIGS. 1A and 1B together show a schematic illustration of a rotary drilling apparatus including a vertical section of the well containing the drill string in which the present invention is employed;

FIG. 2 is an enlarged upper portion of the downhole tool which illustrates details of means for opening and closing the main valve for the circulation of drilling fluid;

FIG. 3 is a view showing the main valve of FIG. 2 in an open position;

FIG. 4 shows the relief valve of FIG. 2 in an open position;

FIGS. 5 and 5A illustrate two positions of a spring-loaded detent during the closing movement of the main valve; FIG. 6 shows the longitudinal slots of the housing shown in FIG. 3;

FIG. 7 is one embodiment of the pressure signal generator of FIG. 1B;

FIG. 8 is another embodiment of the pressure signal generator of FIG. 1B;

FIG. 9 is a cross-sectional view of the pressure signal generator valve of the embodiment of FIG. 8, and FIG. 10 is one embodiment of the measuring unit of FIG. 1.

Figure 11:
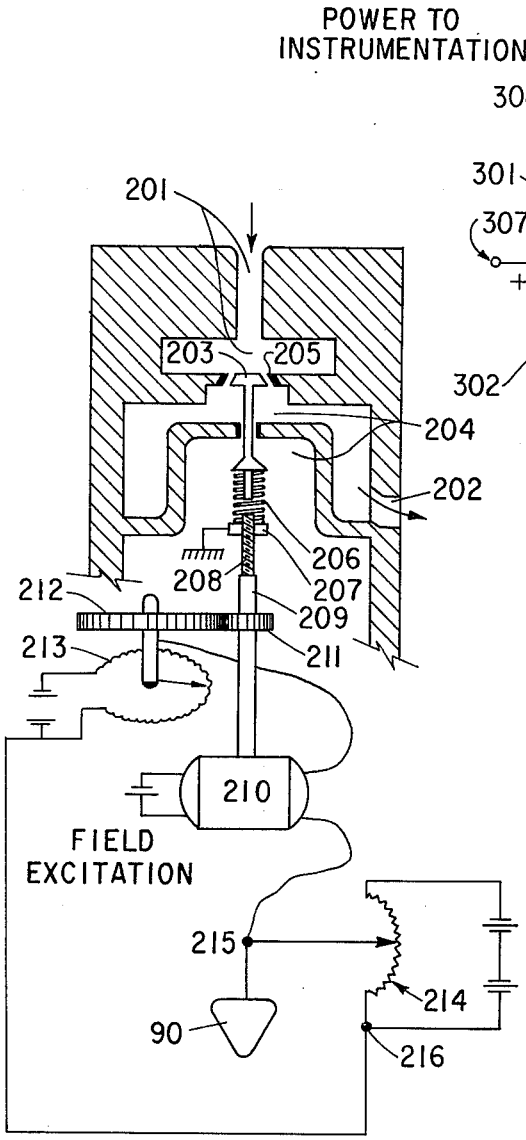
FIG. 11 illustrates another form of pressure signal generator.

Attention is now directed to FIGS. 1A and 1B which show the overall system so that logging can occur during the drilling operation and the signal can be transmitted to the surface without removal of the drill string. Shown thereon is a drilling derrick 10 supporting a drill pipe 18 in a wellbore 12 which is drilled by bit 20 in subsurface formation 14. A surface casing 16 is shown in FIG. 1A.

Attention is now directed primarily to FIG. 1B, which shows the downhole-measuring tool set in the lower end of drill pipe 18. The tool is held in position by slips 22, and rubber packers 24 seal the annulus between the downhole tool and the interior wall of drill string 18 so that all drilling fluid has to go through the upper end 23 of the tool. The downhole tool includes a main valve, a pressure signal generating unit, and a measuring unit. About the middle of the tool is main valve 26, which diverts the fluid flowing in the upper end 23 out through orifice 27 and down the annulus 29 between the outer wall of the pulse generator 28 and the interior wall of the tubing 18. Fluid flows on downwardly through bit 20 back to the surface in a normal manner through the annulus between the outer wall of the drill string 18 and the borehole wall. Means are provided for opening and closing main valve 26 by the proper application of pressure in the drilling fluid at the surface. A pressure change generator 28 is provided below valve 26 and its detail of operations will be described in connection with FIGS. 7 and 8. A measuring unit 30 is connected to the lower end of pulse generator 28. A typical measuring unit 30 is shown in FIG. 10 and will be explained in detail hereinafter. Measuring unit 30 measures a sequence of downhole parameters and upon command causes pressure signal generator 28 to transmit the information to the surface through fluid in drill string 18. In one alternate embodiment, the measuring unit 30 can also store parameter measurements and actuate the pulse generator at a later time.

Attention is now directed back to FIG. 1A. Shown thereon is main mud pump 32 with outlet valve 36 and line 34 leading to kelly 38. Kelly 38 is connected to the upper end of drill string 18 in a conventional manner. A pressure source or pump 42 is connected through outlet valve 44 and conduit lateral 44*a* to main line 34. The pump 42 generates substantially constant pressure at moderate flow volume. An accumulator 44*b* and check valve 44*d* smooth out the pressure pulsations from pump 42 and valve 44*c* can be open, partially open or closed, and can optionally isolate the system 44, 44*a*, 44*b*, 44*d* from the rest of the drilling mud circuit. The operation is such that sudden and quick pressure reductions can occur at sensor 48 in response to pressure signal generator 28; but these reductions will be quickly restored by pressure source 42. It should be noted that the "constant" pressure generated by source 42 can also, as an alternate arrangement, be provided by "idling" the main pump 32 and connecting its output to the line 44*a* by a suitable valve and pressure-limiting device 44*e*. In such embodiment, the "constant" pressure source 42 is dispensed with and moderate volume and substantially constant pressure are then provided by the main pump 32 as the source. A pressure pulse sensor 48 is connected through valve 50 to line 34. The output from pressure pulse sensor 48 is recorded on recorder 52. A mud return line 40 is connected to the annulus between the drill string 18 and surface casing 16.

A brief discussion of the operation of the system of FIG. 1A and 1B will now be given. During normal drilling operations, mud from main pump 32 flows through kelly 38 downwardly through drill string 18. When the mud reaches the lower end of the tool, as shown in FIG. 1B, this main stream of drilling mud enters the upper end of the tool through opening 23 and out through valve 26, and down the annulus 29, as indicated by the arrows and out the bit 20. The drill fluid operates in a normal manner and carries the cuttings made by the bit to the surface through the annulus between the drill string and the borehole wall. When the mud gets to the surface, it flows through mud return line 40, where it is treated and solids removed and then returned to the main pump 32 by well known means not shown. High flow in the drilling string 18 holds valve 26 open to permit this routine operation. When it is desired to measure a downhole parameter and transmit the measurement to the surface, the main pump 32 is stopped or idled, valve 36 closed, and the drilling by rotating drill string 18 is stopped. At this time, valves 44 and 44*c* from the "constant pressure" pump 42 are opened, as is the valve 50, so that the pressure pulse sensor 48 can detect changes in pressure, i.e., pressure pulses, within the drill string 18. This reduced pressure of the drilling fluid in the drill string causes valve 26 to close (the operation of this will be discussed hereinafter). The pressure in pipe 18 is gradually rebuilt to a moderate value. The signal-measuring unit 30 is then turned "on" by the timed pressure switch and is then used to activate pressure generator 28 and to start generating the signals to be transmitted to the surface. The pressure pulses are transmitted to the surface through the relatively quiet but compressed fluid now in drill string 18. Means of accomplishing all these features will now be discussed.

Attention is next directed to FIG. 2, which shows the working components of the main valve 26 and also of relief valve 54. The relief valve will be discussed later. We shall now discuss the main valve 26. We have designed a valve that will remain open when the normal main drilling fluid is acting on it if we have a sufficient flow and consequent pressure differential across the valve. If, for example, the differential is 600 pounds per square inch, or more, the valve 26 will be opened as shown in FIG. 3 and will remain open with sufficient flow, such as 50 gallons per minute, causing a pressure drop of about 50 psi across the valve. However, if we have a lesser differential pressure across the tool, e.g., 250 psi, then the valve 26 will stay closed. By pressure across the tool, we mean the difference in psi of P1, which is the pressure inside the tool adjacent the main valve 26, and the pressure P2 in annulus 29 between the tool and the inner wall of the drill string 18. Shown in FIG. 2 is a main housing 19, which is connected at the lower end to joint 55 (of FIG. 8), which is connected to the pulsing section and at the upper end to the slips 22 and rubber packer 24 shown in FIG. 1B. A valve sleeve 56 is slideably mounted within housing 19. When the sleeve 56 is in its upper position, the main valve orifice 27 is closed as shown in FIG. 2. When the sleeve valve 56 is in its lower position, as shown in FIG. 3, the main valve is open which permits normal circulation of the drilling fluid so that normal drilling operations can proceed. The lower end of sleeve valve 56 is of a reduced diameter beginning at shoulder 58. A fluid bypass passage 74 extends downwardly through the interior of the lower reduced portion of valve sleeve 56. The lower end of bypass fluid passage 74 is fixed to joint 55, which connects into the pulse-generating section 28. The upper end of passage 74 has slots 76 so as to receive fluid going down the inside of drill pipe 18. The lower portion of sleeve valve 56 below shoulder 58 has external shoulders 60 and 62 affixed thereto. The space between shoulder 60 and 62 forms a detent receiving area 69. As shown in FIG. 6, the walls of housing 19 are provided with longitudinal slots 71 in the vicinity of detent receiving area 69, so that it can expand outwardly under force, as indicated by dashed line 75.

A plurality of detents 66 are positioned in detent-receiving space 69 and against face 158 of restraint 68. Detents 66 are each provided with upwardly extending arm 63 which extend upwardly and attach to an annular member 64 which is mounted about the upper end of the reduced portion of sleeve valve 56. Annular detent ring 64, detents 66 and arms 63 are held in their upper position by spring 72.

The detents and restraints which operated successfully on one tool we built had the following facial angles. Referring to FIG. 5A, on detent 66, forward face 150 had an angle of 15°, shoulder 152 an angle of 90°, rearward face 153 had 0°, forward face 154, 45°, restraint 68 had face 156 of 45°, and face 158 of 45°. Shoulder 62 of sleeve valve 56 had a forward face 170 of 45°, surface 171 had 0°, and shoulder 172 had 90°.

All angles given were measured with respect to the longitudinal axis of the tool.

There are two forces which resist downward movement of sleeve valve 56. These forces must be overcome before the valve 26 can be opened. These two forces are (1) helical spring 70, which exerts an upward force on shoulder 60, and (2) the other is a force required to force detent 66 by collet-type restraint 68. The downward force on sleeve valve 56 is the high-pressure fluid acting on the upper end of sleeve valve 56, which is really the area between sleeve seal 80 between the outer wall of sleeve valve 56 at its upper end and the housing, and seal 84 between fluid bypass passage 74 and the interior of the reduced diameter portion of sleeve 56. The actual pressure acting on this area is essentially $P_1$–$P_2$.

When high-pressure fluid is supplied inside the drill pipe 18, it acts on the upper surfaces of sleeve valve 56 and forces the sleeve downwardly. In doing so, it must overcome the force of spring 70 and also must be sufficiently great to expand the collet-type restraints 68 to allow passage of detents 66 by restraints 68. The detents are then in the position shown in FIG. 3, and as long as the downward force is greater than that of the upper force, the valve stays open and fluid flows as indicated. As long as there is fluid flow downward through valve 26, $P_1$ is greater than $P_2$. When it is desired to close the valve 56, all that is necessary to do is to stop the flow of drilling fluid so that $P_1$ and $P_2$ become essentially the same. When this occurs, spring 70 forces the sleeve 56 upwardly. A spring-loaded detent 66 retracts into receiving space 69 during the closing movement of the valve to allow it easy movement past restraints 68 which are not required to expand in this phase of the operation. On the downward movement, the detent restraint 68 had to expand because detents 66 were against shoulder 62 which did not allow the detent to move inwardly. FIGS. 5A, 5 and 3 show progressive positions of detent 66 as the main valve is opened.

Attention is next directed to the relief valve which is shown in FIG. 4 in the open position and shown in its closed position at the upper end of FIG. 2. Shown thereon are relief valve port means 81 which in FIG. 2 are closed by sleeve valve 82. Sleeve valve 82 is disposed in annular chamber 84 with movement between an upper position, as shown in FIG. 2, and a lower position as shown in FIG. 4. The sleeve valve 82 is held in its closed position by a shear pin 86. Emergency mud relief valve 82 is caused to be opened when the pressure of the circulating mud down the drill string exceeds by a selected amount that normally required to open the circulating valve. Shear pin 86 is selected to have a strength such that it will be sheared when this pressure is reached. The pressure will be normally in the order of 200 or 300 pounds per square inch or so in excess of the pressure normally required to open main circulating valve 26. When relief valve 82 is opened, it permits normal drilling operations even though main valve 26 may be stuck shut.

We will next discuss briefly a typical measuring unit 30 for use in the tool of FIG. 1A and 1B. This can be any downhole measuring unit to measure inclination of the borehole, its direction, the intensity of natural gamma rays emitted by the formations, their electric resistivity, or any other downhole parameter. A typical measuring unit 30 is shown in FIG. 10. This one is used to detect borehole inclination, that is, how far off the vertical is the wellbore. This includes a pendulum 90 which seeks its vertical position and is connected to potentiometer 92 by moving arm 94. Moving arm 94 moves with the pendulum 90 and the voltage output from the potentiometer is thus an indication of the angle of the borehole. The potentiometer 92 is rigidly connected to housing **90*a*, which is positioned in the tool to assume the same angle of deviation as does the drill pipe 18. The housing 90*a* is pivotally supported. Weights 90*c* are arranged to swing housing 90*a* so that the weights are always on the "low" side of the instrument. The output from potentiometer 92 is connected to encoder 98 which has output 99 which can be connected directly to pulse generator 28. If desired, the output 99 from encoder 98 can be connected to storage 100. In this arrangement, storage 100 has an output on output 102 upon being pulsed by a read pulse 104.**

An important feature of this invention is the provision of means to close the drill pipe at both ends. This "closed" system can then be pumped up to a substantial pressure and by this application of pressure the mud column transmission characteristics are greatly improved. First, much of the gas which contributes to the elasticity of the mud is greatly compressed in volume and some goes into solution in the mud; and, secondly, since the mud is substantially quiescent, no large pump pulsations are present. Thus, the signal-to-noise ratio for pressure change transmission is greatly improved.

Attention is next directed to FIG. 7 which shows a convenient form of embodiment of pressure change generator 28 of FIG. 1B. At the upper end of FIG. 7 is joint 55 which connects the pressure change system with bypass fluid passageway 74. The flowpath is as indicated by the arrows 106 which show the fluid flowing through a valve means 108 through low-pressure mud outlet 110. Valve 108 is in chamber 112. When valve 108 is in its downward position, the valve is closed and no fluid flows out outlet port 110. However, when valve 108 is moved to its upper position, the valve is open. We shall discuss briefly means for keeping valve 108 in closed position. This includes compression spring 116 and magnet unit 118. Magnet unit 118 includes a permanent magnet 120, a soft iron magnetic shunt 122, a soft iron pole piece 124, coil 126 and a soft iron ring 128. When coil 126 is not energized, the permanent magnet 120 holds the iron pole piece 124 in place. The iron pole piece 124 is connected by rod 114 to rod 108. Thus, both the compression spring 116 and the magnet unit 118 tend to hold the valve closed.

Figure 12:
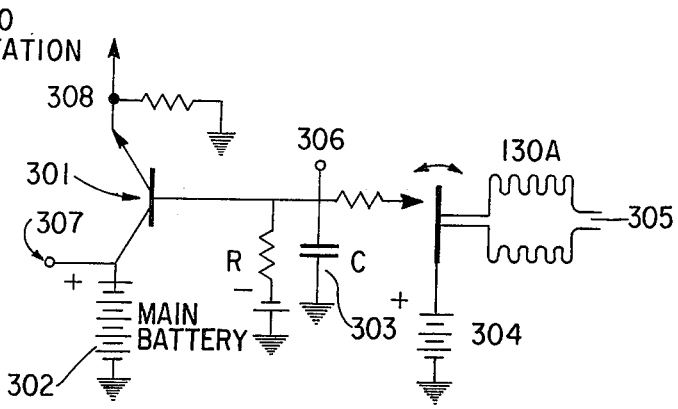
FIG. 12 illustrates a timed "on-off" switch.

We shall next discuss means for opening valve 108. This includes means for supplying a pulse of current to coil 126 which reacts against the permanent magnet 120 and it, together with the pressure of the fluid on valve 108, causes valve 108 to move upwardly and open. In moving up, valve 108 also compresses spring 116. To avoid any excessive pressure buildup in the compartment in which compression spring 116 is, a pressure balancing channel 117 is provided between that channel and the output on the outside of the tool through outlet port 110. After the coil 126 has been de-energized and the pressure equalized across the valve, the valve 108 will be forced to a closed position. This closing is, however, made to be slow by check valve 117A. However, first, we will discuss means for energizing coil 126. To initiate this, the measuring unit must be told or pulsed to start, reading out the information. We will now discuss means for directing the measuring unit 30 to supply signals so that valve 108 can be opened and closed in the proper sequence to generate pressure variations in the fluid within the drill string 18. First, we must have a signal to cause the measuring unit to start operation. This signal is obtained from pressure switch 130 which is connected by channel 134 to the high-pressure fluid upstream of valve 108 and through outlet 132 to the low pressure fluid exterior the tool. Pressure switch 130 is merely a pressure differential switch such that when differential pressure between the fluid conduits 134 and 132, is sufficiently high, switch 130 closes. This pressure differential could, for example, be about 200 psi, which would cause the switch 130 to emit a pulse. This pressure is obtained by having valve 26 closed. It will be recalled that valve 26 is designed such that it takes a relatively high pressure, e.g., 600 pounds or more, above the exterior of the tool and annulus 29 to cause it to open. If the pressure is only about 200 pounds greater inside the passageway 74 than in annulus 29, then valve 26 will stay closed, but the pressure switch 130 will emit a signal to the "on-off" circuit shown in FIG. 12. FIG. 12 is a conventional "timed" switch arrangement in which numeral 301 is a large PNP switching transistor which is adapted to connect power to the entire subsurface instrumentation from standard high temperature batteries 302. The operation is as follows: when pressure switch 130A is closed by pressure, condenser 303 is quickly charged from battery 304 and turns "on" the switching transistor 301, and it becomes substantially a short circuit and essentially all the voltage is from battery 302 which is applied to the subsurface instrumentation. Should the pressure at the input 305 momentarily drop because of the transmission of a pressure pulse up the drill pipe, the switch 130A may open. The transistor switch 301 will under such circumstances remain closed for a length of the time, determined by R and C on the circuit of FIG. 12.

The pulses from encoder 98 of FIG. 10 are conducted to coil 126 of FIG. 7 and activate it to cause valve 108 to open and close in a timed sequence so that pulses are generated in a timed sequence in accordance with the data measured. This information gives a measure, for example, of the inclination of the borehole that is reflected at the relative position of pendulum 90 of FIG. 10 with respect to the balance of the tool. The power for the pulses from encoder 98 is conveniently obtained using the arrangement of FIG. 12. Before the pressure switch 130 can be activated, there must be a pressure differential across it. This requires that valve 26 be closed. To obtain this closure, what is normally done is to close down or disconnect main pump 32, shut off valve 36, start up the constant pressure pump 42 or connect the auxiliary pressure source through **44*e* so that a moderate pressure will be in the drill string 18. Valve 50 is then opened so that the pressure pulse sensor can sense and detect any pressures caused by opening and closing the valve 108. This pulse is detected by sensor 48 and is then recorded on recorder 52.**

Attention is now directed to FIG. 8 which indicates an alternate embodiment to the one shown in FIG. 7 for the pressure change generator 28 of FIG. 1B. It is believed that this is a preferred embodiment. This unit ties into the bypass pressure fluid passageway 74 and joint 55 in the same manner as does the embodiment in FIG. 7. This includes a valve 140 and an outlet passage 142. When valve 140 is opened, the mud from conduit 74 is discharged. When it is closed, the pressure builds up in conduit 74. This opening and closing of this valve causes pressure signals to be built up in the mud channel in the drill string 18 in the same manner as opening and closing valve 108 in the embodiment in FIG. 7. Valve 140 is a rotary type valve. When in one position of rotation, it is closed, and when it is in its second position, it is open. As shown in FIG. 9, valve 140 has passageways 144, and when it is aligned with the opening 142, the valve is open. When it is not aligned, the valve is closed. The rotation of valve 140 is effected through a valve stem means 146 which is connected to rotational solenoid motors 150 and 152, which are interconnected by member 154. One of the solenoid motors 150 turns the valve clockwise to a closed position, and the other turns the valve counterclockwise to an open position. The first pulse from unit 98 causes the valve 140 to open by causing solenoid 150 to rotate its position, and the second pulse causes the valve to close by the rotation of rotational solenoid motor 152. The embodiment of FIG. 8 and the pressure switch 166 functions very similarly to the pressure switch 130 embodiment of FIG. 7. One side of pressure switch 166 is connected through conduit 168 through the tool and is exposed to the pressure in fluid passage 74. The other side of the pressure switch 166 is connected to be exposed to pressure representative of that exterior of the tool. This is conveniently done through a pressure piston 170 in chamber 180 which is connected to the exterior of the tool. The piston 170 applies pressure to a fluid such as oil in chamber 180 to which one side of the pressure switch 166 is exposed. When the differential pressure to which pressure switch 166 is exposed reaches a selected value, it closes and actuates the timed "on-off" switch of FIG. 12.

For simple operation, the switch 130A is adapted to turn the instrument "on" and the timed circuit of FIG. 12 will maintain this "on" position for a time interval longer than any interval between signal "pulses". As an alternate arrangement, an additional circuit shown in FIG. 12A can be used to shunt the switch transistor 301 with a second switch-transistor 308. This second transistor is turned on by the "scale of two" circuit 309. Thus, the instruments can be turned "on" for an indefinite period of time and will remain turned on even after the RC time constant of the circuit of FIG. 12 has been spent. The "scale of two" circuit 309 can then turn the instrument "off" by the transmission of a further pressure increase sent from the surface.

Figure 12A:
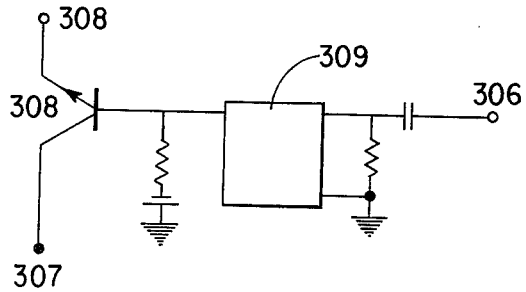
FIG. 12A illustrates an electrical circuit useful in commanding the pressure signal generator.

By use of the circuit of FIG. 12A, a number of additional desirable features can be achieved, for example:

1. Bottom-hole data can be stored during normal drilling and the instrument remains "on" and storing the data until a command pulse is transmitted from the surface which can actuate a "read" impulse to the data storage system.

2. The instrument can be commanded from the surface to be actuated from a plurality of subsurface transducers in sequence, the first pressure pulse from the surface connecting the encoder 98 to transducer No. 1, the second pressure pulse connecting the encoder 98 to a second transducer, the third pressure pulse from the surface connecting the encoder 98 to a third transducer, and so on.

Another embodiment of this invention (which is particularly suitable when only one parameter measurement is to be transmitted) comprises the method in which the magnitude of the pressure variation is used as the measure of the transmitted signal. Thus, the magnitude of the pressure signal in psi can be made to bear a functional relationship to the magnitude of the parameter being measured. FIG. 11 illustrates an apparatus for practicing the method.

In FIG. 11, the apparatus shown thereon is placed in the position occupied by the apparatus of FIG. 8. Referring now to FIG. 11, the representation is diagrammatic: Numeral 201 corresponds to the passage 74 of FIG. 8 and allows high pressure mud to enter the chamber 201 and numeral 202 represents the output port through which the mud is dumped into the low pressure region. Valve 203 is slidingly mounted in bushing and packing 204 and is pressed against seat 205 by compression spring 206. Spring 206 is supported on nut 207 which is held so it cannot turn by means not shown. The nut 207 is, however, free to move up and down in response to screw thread 208. Thus, a mud pressure in chamber 201 tends to open the valve 203 by pushing it downwardly, but the spring 206 tends to keep the valve closed by exerting an upward force thereon. When the mud pressure in chamber 201 produces a downward force on valve 203 that exceeds the upward force produced of spring 206, the valve will open. The screw thread 208 and nut 207 are arranged so that when the screw thread is turned, the compression on spring 206 is varied. Thus, the angular position of screw 208 and shaft 209 will determine the compression on spring 206, and this in turn determines the pressure in chamber 201 that is required to open the valve 203. For each angular position of shaft 209, there is a corresponding unique pressure value in chamber 201 above which the valve 203 will open and discharge the mud into outlet 202. The shaft 209 is driven by motor 210 which is arranged to turn the shaft clockwise or counterclockwise by means of the self-balancing potentiometer arrangement comprising gears 211, 212 and potentiometer 213 in a manner well known in the art. The potentiometer 214 corresponds to potentiometer 29 of FIG. 10. Thus, for each inclination angle of the tool in the well, there is a corresponding angular position of potentiometer 214 with respect to the pendulum 90 and a corresponding voltage at terminals 215, 216. This voltage is impressed upon the armature of electric motor 210, which rotates the shaft 209 until, through gearing arrangement 211, 212, the potentiometer 213 produces an equal and opposite voltage at which position the motor stops.

Thus, the spring pressure on the valve 203 is varied so that it bears a unique functional relationship to the angle of inclination and, consequently, the mud pressure in chamber 201 that will open the valve 203 also bears a unique functional relationship to the inclination.

Although the invention has been described with a great degree of detail, it is to be understood that numerous changes can be made thereto without departing from the spirit and scope of the invention.

What we claim is:

1. A method of transmitting data from the bottom of a fluid-filled drill string in a borehole drilled in the earth, which comprises:

a. closing the main path of fluid in said drill string to fluid passage at the bottom of said drill string and at the surface of the earth;

b. applying fluid pressure at the top of the closed string;

c. generating data by measurements in said borehole;

d. relieving said pressure in timed sequences in said closed string in response to said data without opening said main path of fluid;

e. monitoring said pressure at the surface of the earth.

2. A method as defined in claim 1, in which the step of relieving said pressure includes connecting the closed portion of said drill string with the exterior of said drill string at its lower end at intermittent times in response to the data generated at the bottom of the closed string.

3. The method as defined in claim 2, in which the step of closing the lower end of the drill string includes the step of connecting into said drill string a circulating valve that requires relatively high differential pressure to open but will remain open with relatively low differential pressure.

4. A method of logging a well being drilled by using a drilling fluid in a tubular member suspended in the wellbore, which comprises:

a. stopping the circulation of drilling fluid including closing the upper and lower ends of said tubular member, the step of closing the lower end of said tubular member includes preventing flow of fluid through the main flow path in either direction through said lower end;

b. measuring a downhole parameter;

c. generating pressure variations at the bottom of said tubular member in said drilling fluid in response to the parameters measured; and d. detecting the pressure variations at the surface.

5. A method as defined in claim 4, in which the step of generating pressure variations includes applying pressure at a relatively constant value at the surface to said closed tubular member and connecting the closed portion of said tubular member near its bottom with the exterior of said tubular member at intermittent times in response to the said measured parameters.

6. The method as defined in claim 5, in which the step of closing the lower end of the tubular member includes the step of connecting into said tubular member a circulating valve that requires relatively high differential pressure to open but will remain open with relatively low differential pressure.

7. A method of logging a well drilled using a drilling fluid circulated in a tubular member suspended in the well, which comprises:

a. stopping the circulation of drilling fluid;

b. obtaining a downhole measurement;

c. generating pressure variations in said drilling fluid at the bottom of said tubular member indicative of said measurement, said generating being while said circulation of said drilling fluid is stopped;

d. detecting the pressure variations in said drilling fluid at the surface.

8. A system of logging a well being drilled in the earth, which comprises:

a. a drill string suspended in the borehole;

b. a mud pump connected to the upper end of said drill string;

c. a fluid pressure source;

d. means to selectively connect said mud pump or said pressure source to said drill string;

e. a closable circulating valve at the lower end of said drill string operable to open from its closed position when the $\Delta P$ across it exceeds a selected value, and will remain open at a $\Delta P$, lower than said selected value;

f. measuring means to measure downhole parameter;
g. pressure-variation generating means in the lower end of said drill string to generate pressure changes in response to said measuring means;
h. detecting means at the surface to detect pressure changes of the fluid within said drill string.

9. A system as defined in claim 8, in which said pressure generating means includes:
an outlet in the wall of said drill string;
a fluid conduit extending from said outlet to the upper interior of said drill string;
a rotatable valve in said fluid conduit which in a first rotational position closes said fluid conduit and in a second rotational position opens said fluid conduit;
pulsing generating means for generating pulses in response to said measuring means;
first means to rotate said rotatable valve to its first rotational position only upon receiving each of every other pulse from said pulsing generating means;
second means to rotate said rotatable valve to its second position upon receiving the alternating pulses from said pulse generating means which do not actuate said first means.

10. A system as defined in claim 8 in which said pressure-pulse generating means includes a pulse-generating valve means connecting the interior of said drill string above said circulating valve with the interior of the drill string downstream of the circulating valve, and including means to open and close said pulse-generating valve in response to the parameters recorded on said measuring means.

11. A system as defined in claim 10, including a recording means to record the parameters detected by said measuring means and a pressure switch to activate said recording means when the differential pressure across said closed circulating valve exceeds a given minimum.

12. A system as defined in claim 11, in which said pulse-generating valve includes:
a longitudinal chamber;
an inlet to said chamber, said inlet being connected to the interior of said drill string upstream of said chamber;
an outlet conduit from said longitudinal chamber and spaced longitudinally from said inlet;
a plunger valve within said longitudinal chamber which in one position closes said outlet conduit and in a second position to open said conduit; and
means to move said plunger valve in response to the measured parameters.

13. A system as defined in claim 12, in which said pressure-pulsing means includes a downhole pulsing valve downstream of said circulating valve;
said pulsing valve having an inlet and an outlet, said inlet connected to the interior of said drill string and said outlet to the exterior of said pressure pulsing means downstream of said circulating valve;
first means to rotate said pulsing valve to an open position upon a first signal from said measuring means; and
second means to rotate said pulsing valve to a closed position upon receiving a second signal from said measuring means.

14. A system as defined in claim 12, in which said means to move said plunger include:
a permanent magnet:
a soft iron pole piece held by said permanent magnet;
a coil surrounding said soft iron pole piece;
a connecting rod connecting said soft iron pole piece and said valve;
a resilient means urging said valve toward said magnet; and
means connecting said coil to said means for measuring said parameters.

15. A system as defined in claim 14, in which said circulating valve means includes:
a housing having a port means in the walls thereof;
a sleeve valve slideable and mounted within said housing such that in one position it closes said port means and in the other to open said port means, said sleeve valve having a reduced section of reduced diameter;
a hollow fluid passageway sealingly and slidingly fitted in the interior of said reduced section of said sleeve valve, said passageway means being supported from said housing;
an annular ring positioned around the section of reduced diameter of the sleeve valve and adjacent the larger diameter portion;
a reslient means urging said annular ring against the shoulder formed by said larger diameter of the sleeve valve;
detent means;
arms connecting said detent means to said annular member;
collet-type restraints in the wall of said housing adjacent said detent when said sleeve valve is at its closed position; and
a detent-receiving chamber carried between two longitudinally spaced annular shoulders on said sleeve valve with said chamber receiving retracted detents when valve is closing.

16. A method of transmitting data from the bottom of a fluid-filled drill string in a borehole drilled in the earth, which comprises:
a. closing said drill string to fluid passage at the lower end of said drill string and at the surface of the earth, the step of closing the lower end of the tubular member includes a step of connecting into said drill string a circulating valve that requires relatively high differential pressure to open, but will remain open with relatively low differential pressure;
b. applying fluid pressure at the top of the closed string;
c. generating data by measurements in said borehole;
d. relieving said pressure in said closed string in response to said data;
e. monitoring said pressure at the surface of the earth.

17. A method of logging the well being drilled by using a drilling fluid in a tubular member suspended in the wellbore which comprises:
a. stopping the circulation of drilling fluid and closing the upper and lower ends of said tubular member, the step of closing the lower end of the tubular member including the step of connecting into said tubular member a circulating valve that requires relatively high differential pressure to open, but will remain open with relatively low differential pressure;
b. measuring a downhole parameter;
c. generating pressure variations at the bottom of said tubular member in said drilling fluid in response to the parameter measured; and
d. detecting the pressure variations at the surface.

* * * * *